US005995584A

United States Patent [19]

Bhatt

[11] Patent Number: 5,995,584

[45] Date of Patent: Nov. 30, 1999

[54] X-RAY TUBE HAVING HIGH-SPEED BEARINGS

[75] Inventor: Vivek Bhatt, Schenectady, N.Y.

[73] Assignee: General Electric Company, Schenectady, N.Y.

[21] Appl. No.: 09/013,109

[22] Filed: Jan. 26, 1998

[51] Int. Cl.[6] ..... H61J 35/10

[52] U.S. Cl. ..... 378/125; 378/144

[58] Field of Search ..... 378/125, 132, 378/144

[56] References Cited

U.S. PATENT DOCUMENTS

| | | | |
|---|---|---|---|
| 4,819,259 | 4/1989 | Tanaka | 378/125 |
| 4,993,055 | 2/1991 | Rand et al. | 378/125 |
| 5,046,186 | 9/1991 | Rohmfeld | 378/125 |
| 5,241,577 | 8/1993 | Burke et al. | 378/135 |
| 5,274,690 | 12/1993 | Burke et al. | 378/135 |
| 5,483,570 | 1/1996 | Renshaw et al. | 378/132 |
| 5,652,778 | 7/1997 | Tekriwal | 378/132 |

*Primary Examiner*—David P. Porta
*Assistant Examiner*—Drew A. Dunn
*Attorney, Agent, or Firm*—Douglas E. Erickson; Marvin Snyder

[57] ABSTRACT

An X-ray tube assembly including a cathode having an electron emitting surface, a rotatable anode having an X-ray target surface, and a vacuum-enclosing rotatable frame surrounding, and spaced apart from, the electron emitting surface and the X-ray target surface. The frame is hermetically attached to the anode, and the frame includes a totally-annular and X-ray-transparent window ring. Load-carrying bearings are located outside the vacuum of the frame and rotatably support the frame and the anode.

14 Claims, 1 Drawing Sheet

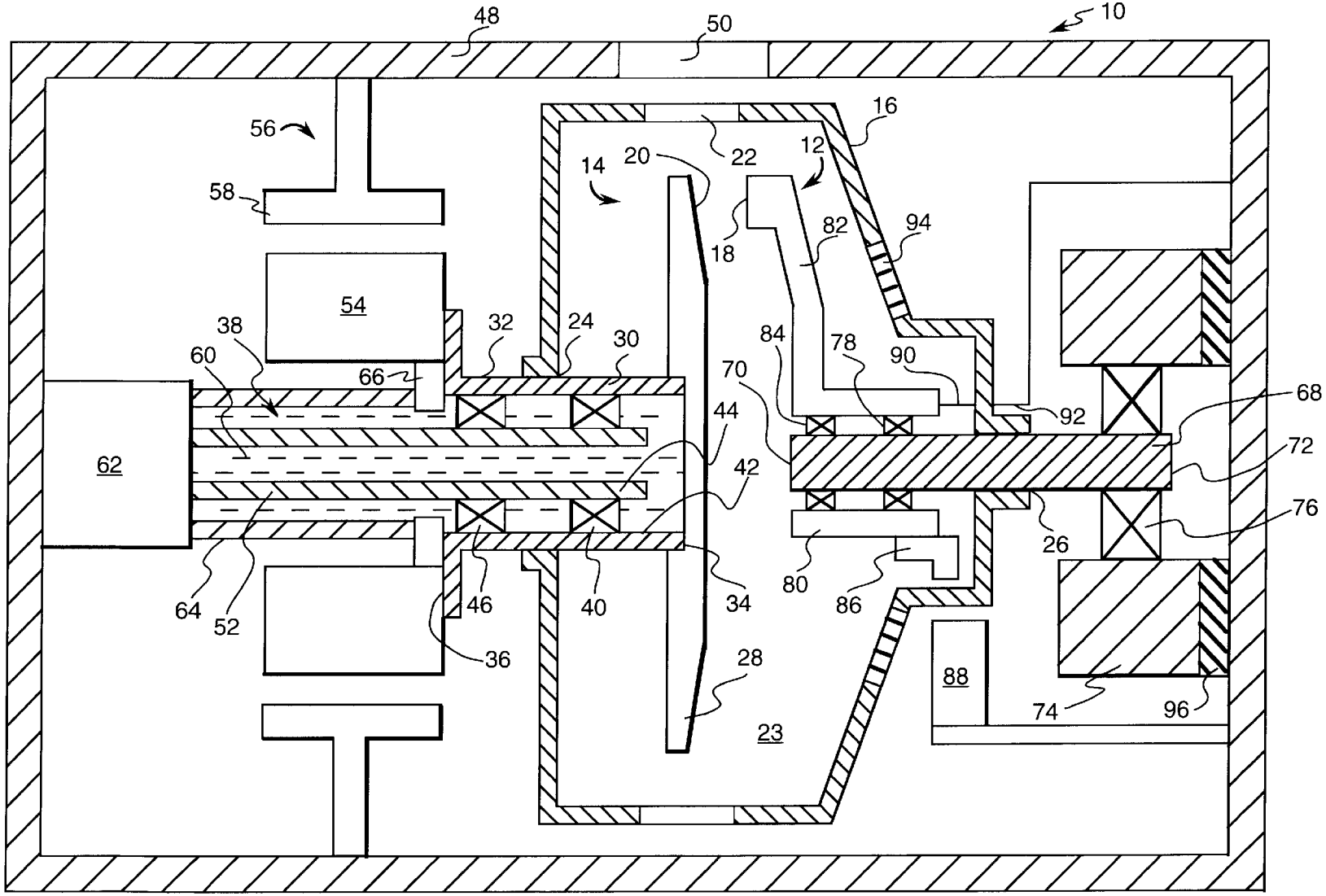
10
12
14
16
18
20
22
23
24
26
28
30
32
34
36
38
40
42
44
46
48
50
52
54
56
58
60
62
64
66
68
70
72
74
76
78
80
82
84
86
88
90
92
94
96

X-RAY TUBE HAVING HIGH-SPEED BEARINGS

FIELD OF THE INVENTION

The present invention relates generally to X-ray tubes, and more particularly to an X-ray tube having a rotating anode which is rotationally supported by a high-speed bearing arrangement.

BACKGROUND OF THE INVENTION

X-ray devices used in the medical field contain an X-ray tube which typically includes a stationary cathode which is heated to emit electrons, a rotating anode having a target surface attached to a cap and generally facing the cathode, and a surrounding glass and/or metal stationary frame containing a vacuum and having an X-ray-transparent window. Some emitted electrons strike the target surface and produce X-rays, and some of the X-rays exit the frame as an X-ray beam through the X-ray-transparent window. Load-carrying bearings are located inside the vacuum between the frame and a stem attached to the cap. The bearings are lubricated by special dry lubricants or by special liquid gallium lubricants. The lubricants tend, in the vacuum, to migrate away from the bearings which will cause increased bearing friction (and which can also cause high voltage instability) which shortens the operating life of the X-ray tube. The target surface is heated by the impinging electrons. The heat is dissipated by thermal radiation from the target surface through the vacuum to the frame and by thermal conduction from the target surface to the cap to the stem to the bearings to the frame. The heated frame is typically cooled by a liquid coolant, such as oil or water, located between the frame and a surrounding casing which has its own X-ray transparent window. The limited cooling arrangement of the tube design restricts the X-ray power output.

What is needed is an improved X-ray tube design having improved lubrication of the bearings and improved cooling of the anode stem.

SUMMARY OF THE INVENTION

In a preferred embodiment, the X-ray tube assembly of the present invention has an X-ray tube cathode, a rotatable X-ray tube anode, and a rotatable and generally-hermetically-sealed frame. The cathode has a first electrical potential and includes an electron emitting surface. The anode is spaced apart from the cathode, has a second electrical potential which is more positive than the first electrical potential, and includes an X-ray target surface generally facing the electron emitting surface. The frame generally surrounds and is spaced apart from the electron emitting surface and the X-ray target surface. The frame is generally-hermetically attached to the anode and includes a totally-annular and essentially-X-ray-transparent window ring.

Several benefits and advantages are derived from the invention. Having the frame be hermetically attached to and rotate with the anode allows the load-carrying bearings to be located outside the vacuum and between the extended anode stem and an interior stationary (and preferably hollow) shaft attached to a surrounding and stationary casing. Such load-carrying bearings can be conventionally lubricated, such as with lubricating oil. The lubricating oil can be directed to flow through the hollow stationary shaft to the anode cap and then returned through the annular passage between the shaft and the surrounding anode stem which contains the bearings. The lubricating oil will also cool the anode cap and anode stem areas allowing increased X-ray power output, as can be appreciated by those skilled in the art. Since the load-carrying bearings and hence the lubricating oil are located outside the frame, the oil cannot migrate into the vacuum within the frame. This avoids the increased bearing friction nd high voltage instability of conventional tube designs that would therwise shorten the operating life of the X-ray tube.

DESCRIPTION OF THE DRAWINGS

The Figure is a schematic cross-sectional view of a preferred embodiment of the X-ray tube assembly of the present invention.

DETAILED DESCRIPTION OF THE INVENTION

Referring now to the drawings, the Figure schematically shows a preferred embodiment of the X-ray tube assembly 10 of the present invention. The X-ray tube assembly 10 includes an X-ray tube cathode 12, a rotatable X-ray tube anode 14, and a rotatable and generally-hermetically-sealed frame 16. The cathode 12 has a first electrical potential and includes an electron emitting surface 18. Preferably, the cathode 12 has a negative voltage of preferably between generally minus sixty kilovolts and generally minus one-hundred-sixty kilovolts.

The rotatable anode 14 is spaced apart from the cathode 12 and has a second electrical potential which is more positive than the first electrical potential. Preferably, the second electrical potential is generally zero. The anode 14 includes an X-ray target surface 20 which generally faces the electron emitting surface 18 of the cathode 12.

The rotatable frame 16, which acts as a vacuum enclosure, generally surrounds and is spaced apart from the electron emitting surface 18 of the cathode 12 and the X-ray target surface 20 of the anode 14. The frame 16 is generally-hermetically (and non-rotatably) attached to the anode 14. The frame 16 includes a totally-annular and essentially-X-ray-transparent window ring 22. By "totally-annular" is meant three-hundred-sixty degrees annular. Beryllium is a preferred material for the X-ray-transparent window ring 22. Preferably, the frame 16 encloses a vacuum 23 of at least generally $10^{-6}$ torr.

In a preferred construction, as shown in the Figure, the frame 16 has a first opening 24 and a second opening 26. The anode 14 also includes a cap 28 and a stem 30. The X-ray target surface 20 is attached to the cap 28. The stem 30 has an outer surface 32 and generally opposed first and second ends 34 and 36. The stem 30 is disposed in the first opening 24 such that the first end 34 of the stem 30 is disposed inside the first opening 24 and the second end 36 is disposed outside the first opening 24. The cap 28 is generally-hermetically (and non-rotatably) attached to the stem 30, and the frame 16 is generally-hermetically (and non-rotatably) attached to the outer surface 32 of the stem 30 between the first and second ends 34 and 36 of the stem 30. An annular block of graphite (not shown in the Figure) may be attached to the back of the cap 28 opposite the X-ray target surface 20 for heat storage purposes, as can be appreciated by the artisan.

The X-ray tube assembly 10 preferably also includes a stationary first support shaft 38 and a first load-carrying bearing 40. The stem 30 also has a generally-annularly-cylindrical shape and an inner surface 42. The first support shaft 38 includes a first portion 44 extending within the stem 30 of the anode 14 and spaced apart from the cap 28 of the anode 14. The first load-carrying bearing 40 is attached to the inner surface 42 of the stem 30 of the anode 14 and to the first support shaft 38. Additional load-carrying bearings, such as load-carrying bearing 46, may also be used to augment the rotational support provided by the first load-carrying bearing 40. The first load-carrying bearing 40 and load-carrying bearing 46 may be located both inside, both outside, or (as shown in the Figure) one inside and one outside, the first opening 24 of the frame 16. However, in all cases, the first load-carrying bearing 40 and load-carrying bearing 46 are both located outside the vacuum 23 of the frame 16, as seen from the Figure.

The X-ray tube assembly 10 further includes a stationary casing 48 generally surrounding and spaced apart from the frame 16. The casing 48 has an essentially-X-ray-transparent window 50. The first support shaft 38 also includes a second portion 52 extending outside the stem 30 of the anode 14. The second portion 52 of the first support shaft 38 is (non-rotatably) attached to the casing 48. The X-ray tube assembly 10 preferably includes a motor rotor 54 and a motor stator 56. The motor rotor 54, which may comprise iron and copper, is disposed between the frame 16 and the casing 48, is spaced apart from the casing 48, and is (non-rotatably) attached to the second end 36 of the stem 30 of the anode 14. The motor stator 56 is disposed inside and is (non-rotatably) attached to the frame 16. The motor stator 56 includes stator windings 58 which circumferentially surround and are spaced-apart from the motor rotor 54.

The X-ray tube assembly 10 preferably includes oil 60 which is used for both lubricating and cooling and which is disposed within the stem 30 of the anode 14 between the inner surface 42 of the stem 30 of the anode 14 and the first support shaft 38. The first support shaft 38 has a generally-annularly-cylindrical shape. The oil 60 is also disposed within the first support shaft 38. An oil pump 62 is disposed inside, and is (non-rotatably) attached to, the casing 48. The second portion 52 of the first support shaft 38 is (non-rotatably) attached to the oil pump 62. A sleeve 64 is (non-rotatably) attached to the oil pump 62, circumferentially surrounds and is spaced apart from the first support shaft 38, and extends to but is spaced apart from the second end 36 of the stem 30 of the anode 14. An oil seal 66 is (non-rotatably) attached to the sleeve 64 and contacts the second end 36 of the stem 30 of the anode 14 to minimize oil leakage between the stationary sleeve 64 and rotating stem 30. In an exemplary arrangement, the oil pump 62 pumps the oil 60 through the first support shaft 38 to the cap 28 of the anode 14, with the oil 60 then returning to the oil pump 62 through the annular gap between the first support shaft 38 and the surrounding stem 30, the surrounding oil seal 66, and the surrounding sleeve 64. Instead of the oil pump 62, spiral grooves (not shown in the Figure) on the inner surface 42 of the stem 30 of the anode 14 may be used to circulate the oil 60.

The X-ray tube assembly 10 preferably further includes a stationary second support shaft 68. The second support shaft 68 includes generally opposed first and second termini 70 and 72. The second support shaft 68 is disposed in the second opening 26 of the frame 16 such that the first terminus 70 is disposed inside the second opening 26 and the second terminus 72 is disposed outside the second opening 26. The frame 16 is generally-hermetically (and non-rotatably) attached to the second support shaft 68 between the first and second termini 70 and 72. The X-ray tube assembly 10 also includes a bearing support 74 and a second load-carrying bearing 76 both disposed outside the frame 16. The second load-carrying bearing 76 is a self-aligning bearing and is attached to the bearing support 74 and to the second support shaft 68. Additional load-carrying bearings (not shown in the Figure) may be used to augment the rotational support provided by the second load-carrying bearing 76. Conventional means (omitted from the Figure for clarity) employing lubricating oil may be used for lubrication of the second load-carrying bearing 76. It is noted that the second load-carrying bearing 76 is disposed outside the vacuum 23 of the frame 16. The casing 48 generally surrounds the bearing support 74, and the bearing support 74 is (non-rotatably) attached to the casing 48.

In an exemplary embodiment, the X-ray tube assembly 10 also includes a third bearing 78, and the cathode 12 also includes an annular flange 80 and an arm 82. The flange 80 is disposed wholly within the frame 16 and generally surrounds and is spaced apart from the second support shaft 68. The arm 82 supports the electron emitting surface 18 of the cathode 12 and is (non-rotatably) attached to the flange 80. The third bearing 78 is attached to the flange 80 and to the second support shaft 68. Additional bearings (such as bearing 84) may be employed to provide a more balanced rotational support between the flange 80 and the second support shaft 68. Because the lightweight cathode 12 does not place a significant load on the third bearing 78 and bearing 84, those bearings (although located in the vacuum 23 and lubricated with special dry lubricants or by special liquid gallium lubricants known to those skilled in the art) are not considered to be load-carrying bearings and do not pose serious lubricant migration problems found when load-carrying bearings are used in a vacuum.

Preferably, the X-ray tube assembly 10 moreover includes magnetically-attracted first and second components 86 and 88. At least one of the two components 86 and 88 is a first magnet, and the other of the two components 86 and 88 is either a second magnet or comprises a material which is magnetically attracted by the first magnet. The first component 86 is disposed within and proximate the frame 16 and is (non-rotatably) attached to the flange 80 of the cathode 12. The second component 88 is disposed outside and proximate the frame 16 and magnetically proximate the first component 86. The second component 88 is disposed within and (non-rotatably) attached to the casing 48. Such an arrangement, or the like, will keep the cathode 12 stationary with respect to the rotating anode 14 and rotating frame 16.

The X-ray tube assembly 10 additionally includes means for providing an electrical feedthrough through the frame 16 to the flange 80 of the cathode 12. Preferably, such means includes first and second electrical-contact brushes 90 and 92. The first brush 90 is attached to the flange 80 of the cathode 12 and contacts the inside of the rotating frame 16. The second brush 92 contacts the outside of the rotating frame 16. An electrical potential applied to the second brush 92 will be carried through the rotating frame 16 to the first brush 90 and to the flange 80 of the cathode 12. Other such means include a stationary ring (not shown in the Figure) whose inner and outer circumferential surfaces are rotatably attached to the frame 16 by roller bearings, and the like.

The choice of materials, not elsewhere mentioned, for the above-described components of the X-ray tube assembly 10 and the addition of electrical insulation or electrically-insulating barriers is left to the artisan as long as the anode 14 and the cathode 12 are kept electrically separate. For example, and as shown in the Figure, the frame 16 and the bearing support 74 each include an annular portion 94 and 96 of electrically-insulating material to act as an electrically-insulating barrier. In another preferred construction (not shown in the Figure), the second support shaft 68 is a ceramic support shaft instead of a metal support shaft. In another exemplary arrangement, the first electrical potential of the cathode 12 is between generally minus thirty kilovolts and generally minus eighty kilovolts, and the second electrical potential of the anode 14 is between generally plus thirty kilovolts and generally plus eighty kilovolts.

Since the load-carrying bearings 40, 46, and 76 and hence the lubricating and cooling oil 66 are located outside the frame 16, the oil 66 cannot migrate into the vacuum 23 within the frame 16. This avoids the increased bearing friction and high voltage instability of conventional tube designs that would otherwise shorten the operating life of the X-ray tube. Less friction and better cooling means the load-carrying bearings 40, 46, and 76 can operate at higher speeds for increased X-ray power output.

The foregoing description of several preferred embodiments of the invention has been presented for purposes of illustration. It is not intended to be exhaustive or to limit the invention to the precise form disclosed, and obviously many modifications and variations are possible in light of the above teaching. It is intended that the scope of the invention be defined by the claims appended hereto.

What is claimed is:

1. An X-ray tube assembly comprising:

a) an X-ray tube cathode having a first electrical potential and including an electron emitting surface;

b) a rotatable X-ray tube anode spaced apart from said cathode, having a second electrical potential which is more positive than said first electrical potential, and including an X-ray target surface generally facing said electron emitting surface;

c) a rotatable and generally-hermetically-sealed frame generally surrounding and spaced apart from said electron emitting surface and said X-ray target surface, wherein said frame is generally-hermetically attached to said anode, and wherein said frame includes a totally-annular and essentially-X-ray-transparent window ring; and d) a stationary second support shaft, wherein said frame also has a second opening, wherein said second support shaft includes generally opposed first and second termini, wherein said second support shaft is disposed in said second opening such that said first terminus is disposed inside said second opening and said second terminus is disposed outside said second opening, and wherein said frame is generally-hermetically attached to said second support shaft between said first and second termini.

2. The X-ray tube assembly of claim 1, wherein said frame encloses a vacuum of at least generally $10^{-6}$ torr.

3. The X-ray tube assembly of claim 1, wherein said second electrical potential is generally zero.

4. The X-ray tube assembly of claim 1, wherein said frame has a first opening, wherein said anode also includes a cap and a stem, wherein said X-ray target surface is attached to said cap, wherein said stem has an outer surface and generally opposed first and second ends, wherein said stem is disposed in said first opening such that said first end is disposed inside said first opening and said second end is disposed outside said first opening, wherein said cap is generally-hermetically attached to said stem, and wherein said frame is generally-hermetically attached to said outer surface between said first and second ends.

5. The X-ray tube assembly of claim 4, also including a stationary first support shaft and a first load-carrying bearing, wherein said stem also has a generally-annularly-cylindrical shape and an inner surface, wherein said first support shaft includes a first portion extending within said stem and spaced apart from said cap, and wherein said first load-carrying bearing is attached to said inner surface and to said first support shaft.

6. The X-ray tube assembly of claim 5, also including a stationary casing generally surrounding and spaced apart from said frame, wherein said first support shaft includes a second portion extending outside said stem, and wherein said second portion is attached to said casing.

7. The X-ray tube assembly of claim 6, also including oil disposed within said stem between said inner surface and said first support shaft, wherein said first support shaft has a generally-annularly-cylindrical shape, and wherein said oil is also disposed within said first support shaft.

8. The X-ray tube assembly of claim 6, also including a motor rotor disposed between said frame and said casing and attached to said second end of said stem.

9. The X-ray tube assembly of claim 1, also including a bearing support and a second load-carrying bearing both disposed outside said frame, wherein said second load-carrying bearing is attached to said bearing support and to said second support shaft.

10. The X-ray tube assembly of claim 9, also including a stationary casing generally surrounding and spaced apart from said frame and generally surrounding said bearing support, wherein said bearing support is attached to said casing.

11. The X-ray tube assembly of claim 1, also including a third bearing, wherein said cathode also includes an annular flange disposed wholly within said frame and generally surrounding and spaced apart from said second support shaft and further including an arm supporting said electron emitting surface and attached to said flange, and wherein said third bearing is attached to said flange and to said second support shaft.

12. The X-ray tube assembly of claim 11, also including magnetically-attracted first and second components, wherein said first component is disposed within and proximate said frame and attached to said flange, and wherein said second component is disposed outside and proximate said frame and magnetically proximate said first component.

13. The X-ray tube assembly of claim 12, also including a stationary casing generally surrounding and spaced apart from said frame, wherein said second component is disposed within and attached to said casing.

14. The X-ray tube assembly of claim 11, also including means for providing an electrical feedthrough through said frame to said flange.

* * * * *